US007355578B2

(12) United States Patent
Enjo

(10) Patent No.: US 7,355,578 B2
(45) Date of Patent: Apr. 8, 2008

(54) SEMICONDUCTOR INTEGRATED CIRCUIT DEVICE HAVING ROM DECODER FOR CONVERTING DIGITAL SIGNAL TO ANALOG SIGNAL

(75) Inventor: Hiroyasu Enjo, Ohtsu (JP)

(73) Assignee: NEC Electronics Corporation, Kanagawa (JP)

( * ) Notice: Subject to any disclaimer, the term of this patent is extended or adjusted under 35 U.S.C. 154(b) by 725 days.

(21) Appl. No.: 10/668,960

(22) Filed: Sep. 24, 2003

(65) Prior Publication Data

US 2004/0062131 A1 Apr. 1, 2004

(30) Foreign Application Priority Data

Sep. 27, 2002 (JP) ..... 2002-282088

(51) Int. Cl.
*G09G 3/36* (2006.01)

(52) U.S. Cl. ..... 345/89; 345/204; 345/206; 345/690

(58) Field of Classification Search ..... 345/89, 345/204, 206, 690
See application file for complete search history.

(56) References Cited

U.S. PATENT DOCUMENTS 6,160,275 A * 12/2000 Nishio et al. ..... 257/206

FOREIGN PATENT DOCUMENTS

JP 2000-221927 8/2000

* cited by examiner

*Primary Examiner*—Richard Hjerpe
*Assistant Examiner*—Leonid Shapiro
(74) *Attorney, Agent, or Firm*—Young & Thompson

(57) ABSTRACT

With respect to gate wires 34P arranged in a P-ROM decoder 216P, two confronting gate wires 34P to which one bit of a digital signal representing a gradation level is input with being non-inverted or inverted are paired, and the width of the gate wire that contains the upper portion of the depletion type transistor 2P (kept under ON-state at all times) and from the depletion type transistor 2P until the enhancement type transistors 1P adjacent to the depletion type transistor 2P is set to a half of the gate wire width L on the transistor 1P inside the gate wires 34P.

15 Claims, 7 Drawing Sheets

PRIOR ART

PRIOR ART

PRIOR ART

PRIOR ART

PRIOR ART

SEMICONDUCTOR INTEGRATED CIRCUIT DEVICE HAVING ROM DECODER FOR CONVERTING DIGITAL SIGNAL TO ANALOG SIGNAL

BACKGROUND OF THE INVENTION

1. Field of the Invention

The present invention relates to a semiconductor integrated circuit device and particularly, to a semiconductor integrated circuit device that has a ROM decoder for converting an n-bit data signal (n represents an integer of 2 or more) representing a gradation level (the n-bit data signal corresponding to a digital signal supplied as image data) to a gradation voltage having the corresponding level of the n-th power of 2 gradation (the gradation voltage corresponding to an analog signal), and drives data lines of a liquid crystal panel on the basis of the gradation voltage thus achieved.

Further, the present invention relates to driving a liquid crystal display device using the semiconductor integrated circuit device.

2. Description of the Related Art

Liquid crystal display devices have been applied to various types of devices such as a personal computer, etc. from the viewpoint of such an advantage that they can be designed to have thin and light bodies and the power consumption thereof is low. Particularly, active matrix type color liquid crystal display devices that are advantageous to control image quality with high precision have been most prevailingly used.

As shown in FIG. 1, a liquid crystal display module of such a type of liquid crystal display device is equipped with liquid crystal display (LCD) panel 101 , control circuit (hereinafter referred to as "controller") 102 comprising a semiconductor integrated circuit device (hereinafter referred to as "IC"), plural scan-side driving circuits (hereinafter referred to as "scan-side drivers") 103 and data-side driving circuits (hereinafter referred to as "data-side drivers") 104 which are formed of ICs. The liquid crystal panel 101 is designed in a structure having a semiconductor substrate on which transparent pixel electrodes and thin film transistors (TFT) are arranged, a opposite substrate having a single transparent electrode on the whole surface thereof, and liquid crystal which is sealingly filled in the gap between these two substrates arranged so as to face each other. A predetermined voltage (hereinafter referred to as "common voltage Vcom") is applied to the opposite substrate electrode, and a predetermined voltage is applied to each pixel electrode by controlling TFT having a switching function, whereby the transmissivity of liquid crystal is varied by the potential difference between each pixel electrode and the opposite substrate electrode to display an image. Here, a variable voltage (hereinafter referred to as "gradation voltage") is applied to each pixel electrode to perform an intermediate gradation (gradation display) of an image.

Data lines for transmitting gradation voltages to be applied to the respective pixel electrodes and scan lines for transmitting a switching control signal (scan signal) for TFTs are wired on the semiconductor substrate.

The input side of the controller 102 is connected to personal computer (PC) 105, and the output side thereof is connected to the scan-side drivers 103 and the data-side drivers 104. The output sides of the scan-side drivers 103 and data-side drivers 104 are connected to the scan lines and data lines of the liquid crystal panel 101, respectively. The scan-side drivers 103 and data-side drivers 104 are restricted in chip size by restriction on the manufacture thereof. Accordingly, the output numbers corresponding to the scan lines and data lines which can be output by one IC is limited, and thus it is necessary to arrange plural ICs on the outer periphery of the liquid crystal panel 101 when the size of the liquid crystal panel 101 is large. For example, in the case of a liquid crystal panel for color display of 1024×768 pixels, the respective drivers 103, 104 are practically mounted in a module under the following restriction.

(1) The scan-side drivers 103 need to drive 768 driving lines. Therefore, when each scan-side driver 103 has a driving capability for 192 driving lines, totally four scan-side drivers 103 are needed, and they are arranged in cascade-connection at one side (left side) on the outer periphery of the liquid crystal panel 101.

(2) The data-side drivers 104 need to drive data lines of 1024×3=3072 because three data lines of R(red), G(green), B(blue) are needed for color display of one pixel. For example when each data-side driver 104 has a driving capability of 384 data lines, totally eight data-side drivers 104 are needed and they are arranged in cascade-connection at one side (upper side) on the outer periphery of the liquid crystal panel 101.

A power supply circuit (not shown) for supplying a common voltage Vcom is connected to the opposite substrate electrode.

Image data are transmitted from PC 105 to the controller 102 of the liquid crystal display module, and clock signals, etc. are transmitted from the controller 102 to the respective scan-side drivers 103 in parallel. A vertical synchronization start signal STV is transmitted to the scan-side driver 103 at the first stage, and transferred to each of the cascade-connected scan-side drivers 103 at the subsequent stages one after another.

Timing signals such as clock signals, etc. and data signals are transmitted from the controller 102 to the data-side drivers 104 in parallel. A horizontal synchronization start signal STH is transmitted to the data-side driver 104 at the first stage, and transferred to each of the cascade-connected data-side drivers 104 at the subsequent stages one after another.

Pulse-shaped scan signals are transmitted from the scan-side drivers 103 to the respective scan lines. When the scan signal applied to a scan line is set to high level, all the TFTs connected to the scan line are turned on, and gradation voltages transmitted to the data lines from the data-side drivers 104 are applied to the pixel electrodes through the turn-on TFTs. At this time, the common voltage Vcom is applied from the power supply circuit (not shown) to the opposite substrate electrode. When the scan signal is set to low level and the TFTs are turned off, the potential difference between the pixel electrode and the opposite substrate electrode is kept until a next gradation voltage is applied to the pixel electrode. By transmitting the scan signal to each scan line one after another, predetermined gradation voltages are applied to all the pixel electrodes, and the gradation voltages are rewritten at a frame period, whereby an image can be displayed.

As the data-side driver 104 described above is known a driver equipped with an ROM decoder for converting a digital signal representing an input gradation level to a gradation voltage of an analog signal due to output the graduation voltage (for example, see JPA-2000-221927). A data-side driver using a dot reverse driving method disclosed in JP-A-2000-221927 will be described with reference to FIGS. 2 to 4 on the assumption that the number of data lines is S and the data-side driver has a driving capability of 384.

First, the construction of the data-side driver will be described with reference to FIG. 2.

In FIG. 2, in the data-side driver 120, by supplying a data signal DATA of 6 bits for each color of R, G, B as image data, one gradation voltage VPx, VNx corresponding to the logic of the data signal DATA out of positive-polarity and negative-polarity gradation voltages VP1 to VP64, VN1 to VN64 which are the 6th power of 2 (=64) gradation is alternately applied to each of the 384 data lines every horizontal period while the polarity is alternately changed between the odd-numbered lined and the even-numbered lines.

The data-side driver 120 is equipped with shift register 121, data register 122, data latch 123, level shifter 124, digital analog conversion circuit (hereinafter referred to as "DA converter") 125 and voltage follower output circuit 126 as main circuits as shown in FIG. 2.

The shift register 121 is designed to have 64-bit interactivity, for example. In this shift register 121, for example, a right shift start pulse input/output STHR is selected on the basis of a shift direction switching signal R/L, the "H" level of the start pulse STHR is read in on the basis of the edge of a clock signal CLK every horizontal period, and control signals C1, C2, . . . , C64 for data reading are generated one after another and supplied to the data register 122.

The data register 122 reads the data signal DATA of one scan line supplied at a width of 36 bits (6-bit×6-bit (RGB×2)) on the basis of the control signals C1, C2, . . . , C64 of the shift register 121 every horizontal period.

The data latch 123 holds the data signal DATA of one scan line read into the data register 122 at the timing of a strobe signal STB every horizontal period, and also collectively supplies the data signal DATA thus held to the level shifter 124.

The level shifter 124 increases the voltage level of the data signal DATA from the data latch 123 every horizontal period, and then supplies the data signal to the DA converter 125.

The DA converter 125 sets the data signal thus supplied so that the polarity is alternately changed between the odd-numbered output and the even-numbered output every horizontal period, and supplies, in conformity with each output thereof, one gradation voltage corresponding to the data signal DATA out of the gradation voltages of 64 gradations generated in a gradation voltage generating circuit contained in the DA converter to the voltage follower output circuit 126.

The voltage follower output circuit 126 outputs the gradation voltage thus supplied to each of the 384 data lines with enhanced driving capability every horizontal period while the polarity is alternately changed between the odd-numbered lines and the even-numbered lines.

Next, the construction of the data-side driver 120 on the semiconductor chip will be described with reference to FIG. 3.

In FIG. 3, semiconductor chip 201 is an elongated rectangular semiconductor chip, and internal circuit 202 is disposed at the center portion along the long side in the semiconductor chip 201. As not shown, the output pads corresponding to the data lines of 384 are connected to the internal circuit 202 and disposed at the outer peripheral portion which faces the liquid crystal panel out of both of the outer peripheral portions of the internal circuit 202 in the longitudinal direction, and input pads for start pulse input/output, shift direction switching input, clock input, data input, latch input, etc. and power supply pads for positive power supply, negative power supply and γ-correction power supply are connected to the internal circuit 202 and disposed at the other outer peripheral portion of the internal circuit 202. Some of the output pads may be disposed at a short-side portion or a long-side portion at the input side other than at the long-side portion facing the liquid crystal panel. From the viewpoint of layout, the inside of the internal circuit 202 is designed so that circuit blocks 203 each having L=6 outputs at M=S/L=64 stages are arranged so as to be adjacent to one another in the longitudinal direction of the chip and totally S=384 outputs are achieved. With respect to the circuit blocks 203, the circuit arrangement is partially different between the circuit block 203*a* at the odd-numbered stage and the circuit block 203*b* at the even-numbered stage.

Next, the circuit blocks 203*a* and 203*b* will be described with reference to FIG. 4. The gradation voltage generating circuit contained in the DA converter and the power supply input and signal input from the external are omitted from the illustration.

Both of the circuit blocks 203*a*, 203*b* comprise one-stage shift register 211, data registers 212 of six stages, first change-over switches 213 of three stages, latches 214 of six stages, level shifters 215 of six stages, DA converter 216, second change-over switches 217 of three stages and voltage follower output circuits 218 of six stages. These circuits 211 to 218 described above are successively arranged in the stage structure so that six outputs S1 to S6 are arranged at the long-side side of the liquid crystal panel side of the semiconductor chip 201.

The one-stage shift register 211 generates a control signal for data reading by reading the H level of the start pulse on the basis of the edge of the clock input. The one-stage shift register 211 corresponds to six outputs S1 to S6.

The data registers 212 of six stages read display data of 6 bits as n bits on the basis of the control signal from the shift register 211. Each of the first change-over switches 213 of three stages has two inputs and two outputs to alternately output the display data picked up at an i-th stage (odd-numbered stage) (i=1, 3, 5) of the data registers 212 and an (i+1)-th stage (even-numbered stage) of the data registers 212.

The latches 214 of six stages hold and collectively output the display data from the first change-over switches 213 at the timing of the strobe signal STB. Each of level shifters 215 of six stages converts the voltage level of the display data from the corresponding latch 214 to a level at which the next stage circuit can be driven The DA converter 216 includes P-channel type ROM decoders (hereinafter referred to as "P-ROM decoders") 216P of three stages and N-channel type ROM decoders (hereinafter referred to as "N-ROM decoders") 216N of three stages. The P-channel type ROM decoders 216P of three stages are supplied with positive gradation voltages of 64 gradations to output the gradation voltages from the respective stages one by one on the basis of the display data from the corresponding level shifters 215 and are collectively arranged in a cluster so as to be adjacent to one another in the longitudinal direction of the chip. The N-channel type ROM decoders 216N of three stages are supplied with negative gradation voltages of 64 gradations to output the gradation voltages from the respective stages one by one on the basis of the display data from the corresponding level shifters 215 and are collectively arranged in a cluster so as to be adjacent to one another in the longitudinal direction of the chip. The P-ROM decoders and N-ROM decoders are arranged so as to be adjacent to one another in the longitudinal direction of the semiconductor chip 201.

Each of the second change-over switches 217 of three stages has two inputs and two outputs to alternately output the positive and negative gradation voltages from the DA converter 216 to each of one output side and the other output side. Each of the voltage follower output circuits 218 of six stages outputs the gradation voltages from the one output side and the other output side of the corresponding second change-over switch 217 to an odd-numbered stage and an even-numbered stage respectively.

The shift register 211 are connected to the data registers 212 through wires 221, the data registers 212 are connected to the first change-over switches 213 through wires 222, the first change-over switches 213 are connected to the latches 214 through wires 223, the latches 214 are connected to the level shifters 215 through wires 224, the level shifters 215 are connected to the DA converter 216 through wires 225, the DA converter 216 is connected to the second change-over switches 217 through wires 226 and the second change-over switches 217 are connected to the voltage follower output circuits 218 through wires 227.

It has been also required to further reduce the lay-out area and gate capacity of the ROM decoders 216N, 216P on the semiconductor chip in the data-side driver 120 described above.

SUMMARY OF THE INVENTION

The present invention has an object to provide a semiconductor integrated circuit device which can reduce the layout area and gate capacity of an ROM decoder by shortening the gate length of a depletion type transistor which is designed to be kept under ON-state at all times.

According to a first aspect of the present invention, there is provided a semiconductor integrated device comprising a ROM decoder of n bits for selecting one gradation voltage out of gradation voltages of the n-th power of 2 gradation in connection with data signals of n bits (n represents an integer of 2 or more) representing a gradation level, the ROM decoder having n pairs of confronting gate wires each into which the data signal is input with the non-inverted state on one of the pair and with the inverted state on another of the pair, wherein pairs of the n-th power of 2 each of which comprises an enhancement type transistor and a depletion type transistor kept under ON-state are arranged at predetermined positions one side by one side at the pair of the confronting gate wires, and with respect to each of the pair of the confronting gate wires, the width of the gate wire that contains the upper portion of the depletion type transistor and extends from the depletion type transistor to the enhancement type transistor adjacent to the depletion type transistor is reduced so that recess portions are formed inside the confronting gate wires.

According to a second aspect of the present invention, there is provided a semiconductor integrated device comprising a ROM decoder of n bits for selecting one gradation voltage out of gradation voltages of the n-th power of 2 gradation in connection with data signals of n bits (n represents an integer of 2 or more) representing a gradation level, the ROM decoder having n pairs of confronting gate wires each into which the data signal is input with the non-inverted state on one of the pair and with the inverted state on another of the pair, wherein pairs of the n-th power of 2 each of which comprises an enhancement type transistor and a depletion type transistor kept under ON-state are arranged at predetermined positions one side by one side at the pair of the confronting gate wires, and with respect to each of the pair of the confronting gate wires, the width of the gate wire that contains the upper portion of the depletion type transistor and extends from the depletion type transistor to the position between the depletion type transistor and the enhancement type transistor adjacent to the depletion type transistor is reduced so that recess portions are formed inside the confronting gate wires.

DETAILED DESCRIPTION OF THE PREFERRED EMBODIMENT

A preferred embodiment according to the present invention will be described with reference to the accompanying drawings.

A data-side driver according to an embodiment of a semiconductor integrated circuit device for driving liquid crystal will be described hereunder. The data-side driver has the same basic construction as the data-side driver described above with reference to FIGS. 2 to 4, and the further detailed construction of the data-side driver will be described.

Figure 3:
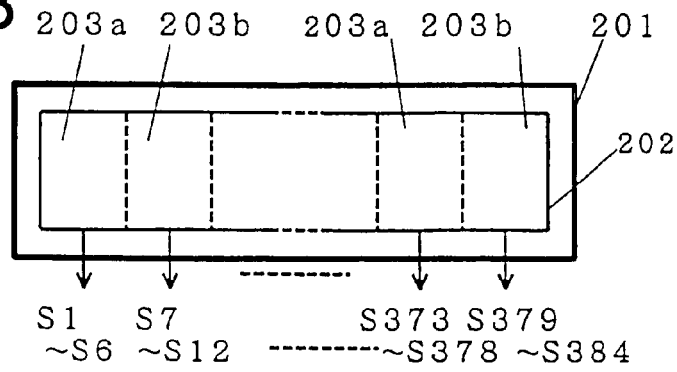
FIG. 3 is a schematic plan view showing a semiconductor chip constructed as the data-side driver of FIG. 2.
Figure 4:
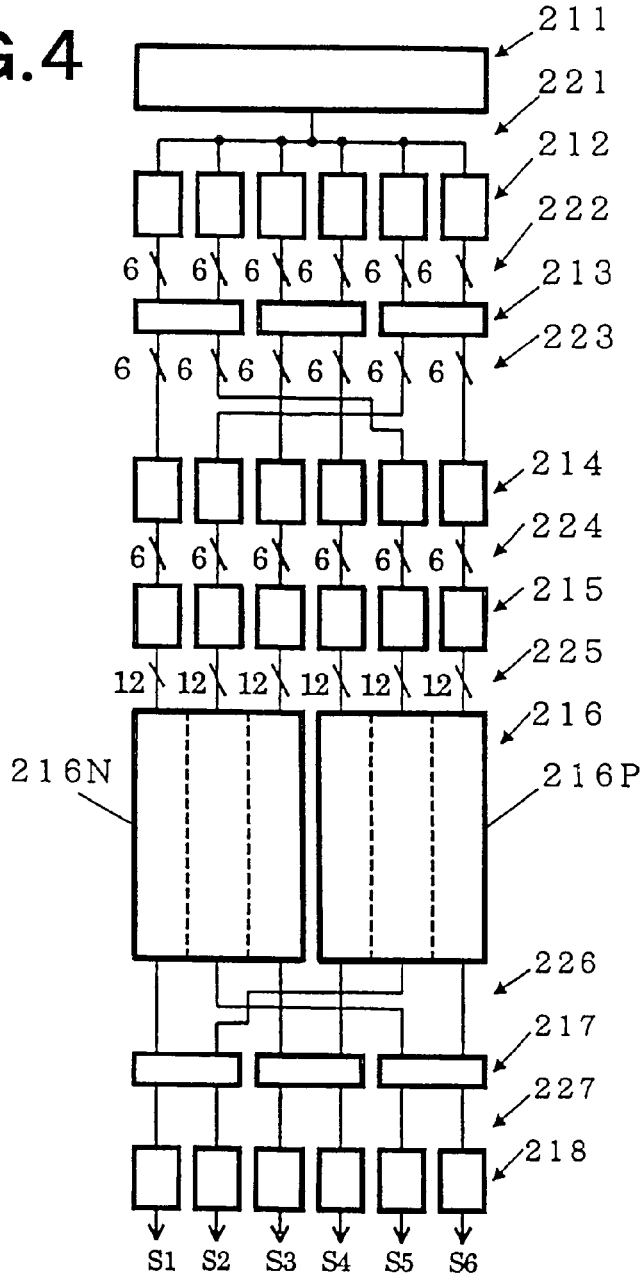
PRIOR ART FIG.4
FIG. 4 is a schematic diagram showing a circuit block arranged on the semiconductor chip of FIG. 3.

On the assumption that the P-ROM decoders 216P and N-ROM decoders 216N of the DA converter 216 of the circuit block 203*a* shown in FIG. 3 are arranged as shown in FIG. 4, the P-ROM decoders 216P and N-ROM decoders 216N of the DA converter 216 of the circuit block 203*b* are disposed in the inverted arrangement to the arrangement of FIG. 4. Therefore, the circuit block 203*a* and the circuit block 203*b* which are adjacent to each other are arranged so that the P-ROM decoder 216P and the N-ROM decoder 216N have a mirror arrangement.

The circuit constructions of the P-ROM decoder 216P and the N-ROM decoder 216N contained in the DA converter 216 shown in FIG. 4 will be described.

Figure 5:
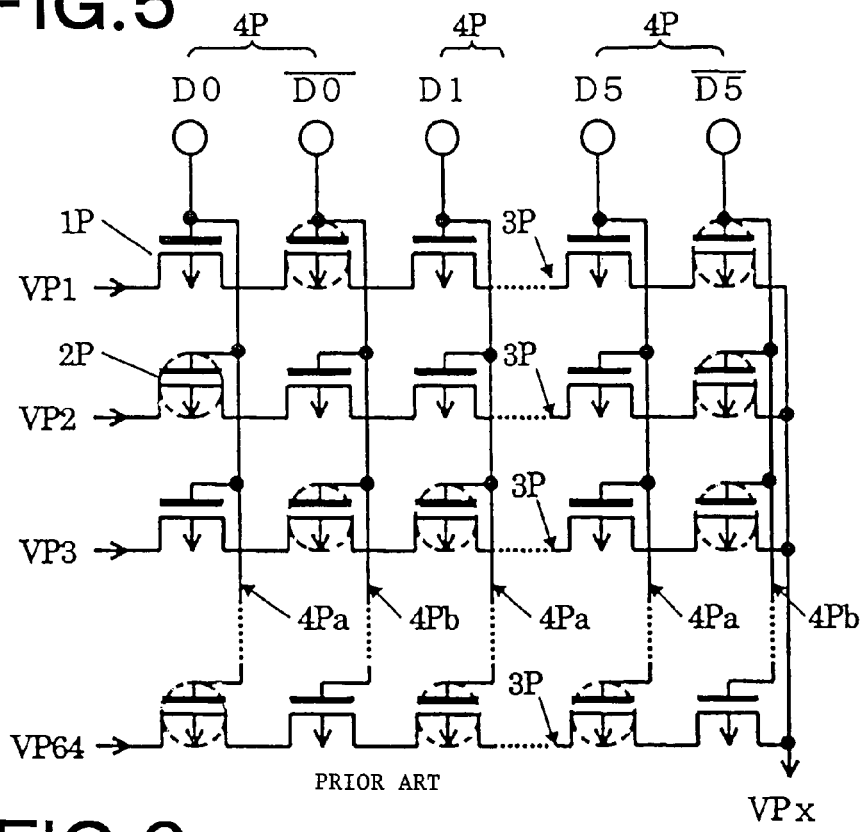
FIG. 5 is a circuit diagram of one stage of P-ROM decoder contained in the circuit block of FIG. 4.

As shown in FIG. 5, the P-ROM decoder 216P includes P-channel enhancement type transistors 1P and P-channel depletion type transistors 2P (kept under ON-state at all times) which are arranged at predetermined positions in a matrix of 64 rows×12 columns. Six pairs of transistors 1P and transistors 2P are arranged on each row, each pair comprising transistor 1P and transistor 2P which are connected to each other in series so that the drain of the transistor 1P and the source of the transistor 2P or the source of the transistor 1P and the drain of the transistor 2P are connected to each other in series, and the combination of the six pairs constituting a transistor in-series circuit 3P.

One gates of the respective pairs of transistors on the respective rows are commonly connected to one another every column to thereby form gate array 4Pa, and the other gates of the respective pairs of transistors on the respective rows are commonly connected to one another every column to thereby form gate array 4Pb. Each gate array 4Pa and each gate array 4Pb constitute gate array pair 4P. The sources of the first-column transistors 1P and 2P at one end sides of the respective transistor in-series circuits 3P are supplied with the positive-polarity gradation voltages VP1 to VP64 of 64 gradations from the gradation voltage generating circuit (not shown), respectively.

The respective gate array pairs 4P are supplied with the data signals D0, D1, . . . , D5 corresponding to data lines of the liquid crystal panel from former stage circuits so that the gate arrays 4Pa are supplied with the positive-phase D0, D1, . . . , D5 and the gate arrays 4Pb are supplied with the inverted phase D0-bar, D1-bar, . . . , D5-bar. The drains of the twelfth transistors 1P and 2P are commonly connected to one another at the other end sides of the respective transistor in-series circuits 3P, and one gradation voltage VPx corresponding to the data signal DATA out of the positive-polarity gradation voltages VP1 to VP64 is output to the subsequent-stage circuit.

Figure 6:
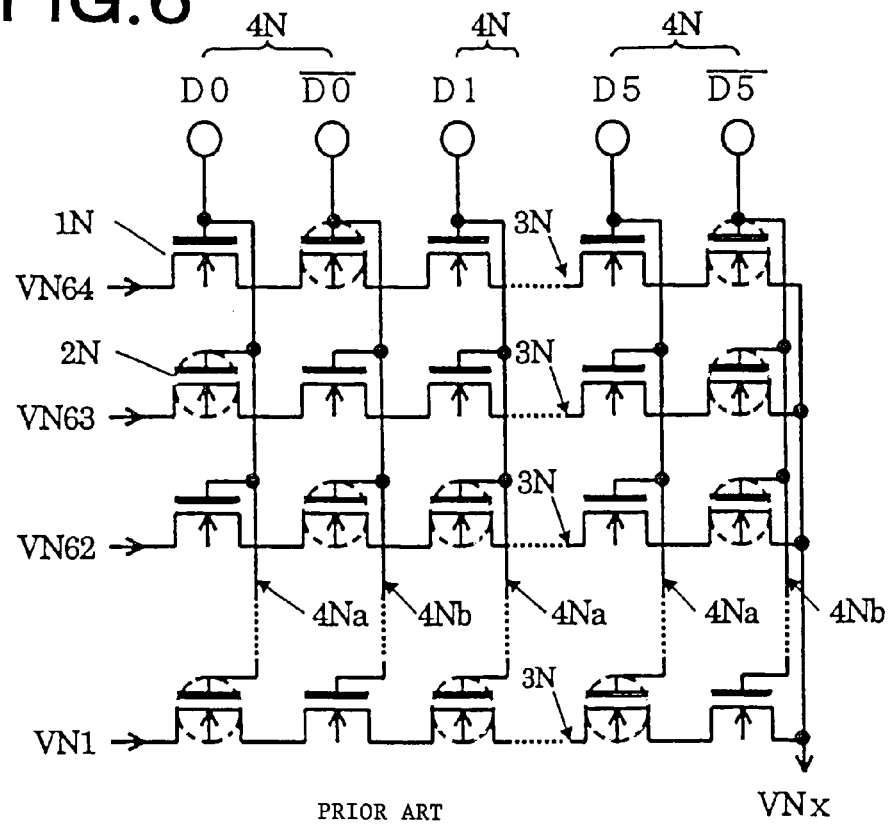
PRIOR ART FIG.6
FIG. 6 is a circuit diagram of one-stage of an N-ROM decoder contained in the circuit block of FIG. 4.

As shown in FIG. 6, the N-ROM decoder 216N includes N-channel enhancement type transistors 1N and N-channel depletion type transistors 2N (kept under ON-state at all times) which are arranged at predetermined positions in a matrix of 64 rows×12 columns.

Six pairs of transistors 1N and transistors 2N are arranged on each row, each pair comprising transistor 1N and transistor 2N which are connected to each other in series so that the drain of the transistor 1N and the source of the transistor 2N or the source of the transistor 1N and the drain of the transistor 2N are connected to each other in series, and the combination of the six pairs constituting a transistor in-series circuit 3N.

One gates of the respective pairs of transistors on the respective rows are commonly connected to one another every column to thereby form gate array 4Na, and the other gates of the respective pairs of transistors on the respective lines are commonly connected to one another every column to thereby form gate array 4Nb. Each gate array 4Na and each gate array 4Nb constitute gate array pair 4N. The drains of the first-column transistors 1N and 2N at one end sides of the respective transistor in-series circuits 3N are supplied with the negative-polarity gradation voltages VN1 to VN64 of 64 gradations from the gradation voltage generating circuit (not shown), respectively.

The respective gate array pairs 4N are supplied with the data signals D0, D1, . . . , D5 so that the gate arrays 4Na are supplied with the positive-phase D0, D1, . . . , D5 and the gate arrays 4Nb are supplied with the inverted phase D0-bar, D1-bar, . . . , D5-bar. The sources of the twelfth transistors 1N and 2N are commonly connected to one another at the other end sides of the respective transistor in-series circuits 3N, and one gradation voltage VNx corresponding to the data signal DATA out of the negative-polarity gradation voltages VN1 to VN64 is output to the subsequent-stage circuit.

Next, the operation of the P-ROM decoder 216P and the N-ROM decoder 216N thus constructed will be described.

The sources, drains of the first-column transistors 1P, 1N and 2P, 2N at one end sides of the respective transistor in-series circuits 3P, 3N are supplied with the gradation voltages VP1 to VP64, VN1 to VN64 of 64 gradations. When predetermined data signals D0, D1, . . . , D5 of "H (high level)" or "L(low level)" are applied to the respective gate array pairs 4P, 4N so that the positive phase D0, D1, . . . , D5 is supplied to the gate arrays 4Pa, 4Na and the inverted phase D0-bar, D1-bar, . . . , D5-bar are supplied to the gate arrays 4Pb, 4Nb under the above state, all the transistors 1P, 1N of a selected transistor in-series circuit 3P, 3N out of the respective transistor in-series circuits 3P, 3N are kept under ON-state (the transistors 2P, 2N are kept under ON-state at all times), and the gradation voltage VPx, VNx applied to the transistor in-series circuit 3P, 3N are taken out.

Next, with respect to the pattern arrangement of the P-ROM decoders 216P and the N-ROM decoders 216N of the DA converter 216 in the circuit block 203*a*, 203*b* on the semiconductor chip 201 is shown as in FIG. 7, assuming that the P-ROM decoders 216P and the N-ROM decoders 216N of the DA converter 216 of the circuit block 203*a* are arranged as shown in FIG. 4, the pattern arrangement of the circuit block 203*a* will be described with reference to FIG. 7. In this case, the P-ROM decoders 216P of three stages arranged in a cluster are disposed so as to be adjacent in the chip longitudinal direction (at the right side in FIG. 7) to the N-ROM decoders 216N of three stages arranged in a cluster. The P-ROM decoder 216P is designed so that three stages of P-type diffusion layers 13P serving as the sources and drains of the transistors 1P, 2P arranged in a matrix of 64 rows×12 columns, and three stages of gate wires 14P serving as six pairs of gate array pairs 4P are contained in an N-well 12 arranged on the P-type semiconductor substrate 11.

The P-type diffusion layers 13P serving as the sources of the respective first-column transistors 1P and 2P are electrically commonly connected to one another by metal wires 15P every line (shown by symbol), and supplied with the respective positive-polarity gradation voltages VP1 to VP64 from the gradation voltage generating circuit.

The P-type diffusion layers 13P serving as the drains of the respective twelfth transistors 1P and 2P are electrically commonly connected to one another through metal wires 16P every column (shown by symbol ■), and one gradation voltage VPx corresponding to the display data out of the positive-polarity gradation voltages VP1 to VP64 is output to the subsequent circuit. The N-ROM decoder 216N is constructed so that three stages of N-type diffusion layers 13N serving as the sources and drains of the transistors IN, 2N arranged in a matrix of 64 rows×12 columns and three stages of gate wires 14N serving as six pairs of gate array pairs 4N are contained in the P-type semiconductor substrate 11 so as to be adjacent to the N-well 12 in the chip longitudinal direction (at the left side in FIG. 7).

The N-type diffusion layers 13N serving as the drains of the respective first transistors 1N and 2N are commonly electrically connected to one another through metal wires 15 every line (shown by symbol ●), and supplied with the respective negative-polarity gradation voltages VN1 to VN64 from the gradation voltage generating circuit. The N-type diffusion layers 13N serving as the sources of the respective twelfth transistors 1N and 2N are commonly electrically connected to one another through wires 16N formed of polysilicon and metal or metal every column (shown by symbol ■), and one gradation voltage VNx corresponding to the display data out of the negative-polarity gradation voltages VN1 to VN64 is output to the subsequent circuit. The P-type diffusion layers 13P and the N-type diffusion layers 13N are arranged so as to keep a distance from each other by a half pitch in the short-side direction of the chip. Conversely to FIG. 7, in the case of the circuit block 203*b*, the P-ROM decoders 216 of three stages arranged in a cluster are disposed so as to be adjacent to the N-ROM decoders 216N of three stages arranged in a cluster in the longitudinal direction of the chip (at the left side in FIG. 7) in the same construction as FIG. 7.

Next, a comparative example of the pattern arrangement of the gate wires 14N, 14P of the ROM decoders 216N, 216P on the semiconductor chip 201 will be described by using the gate wires 14P of the P-ROM decoder 216P as an example with reference to FIG. 8.

Figure 8:
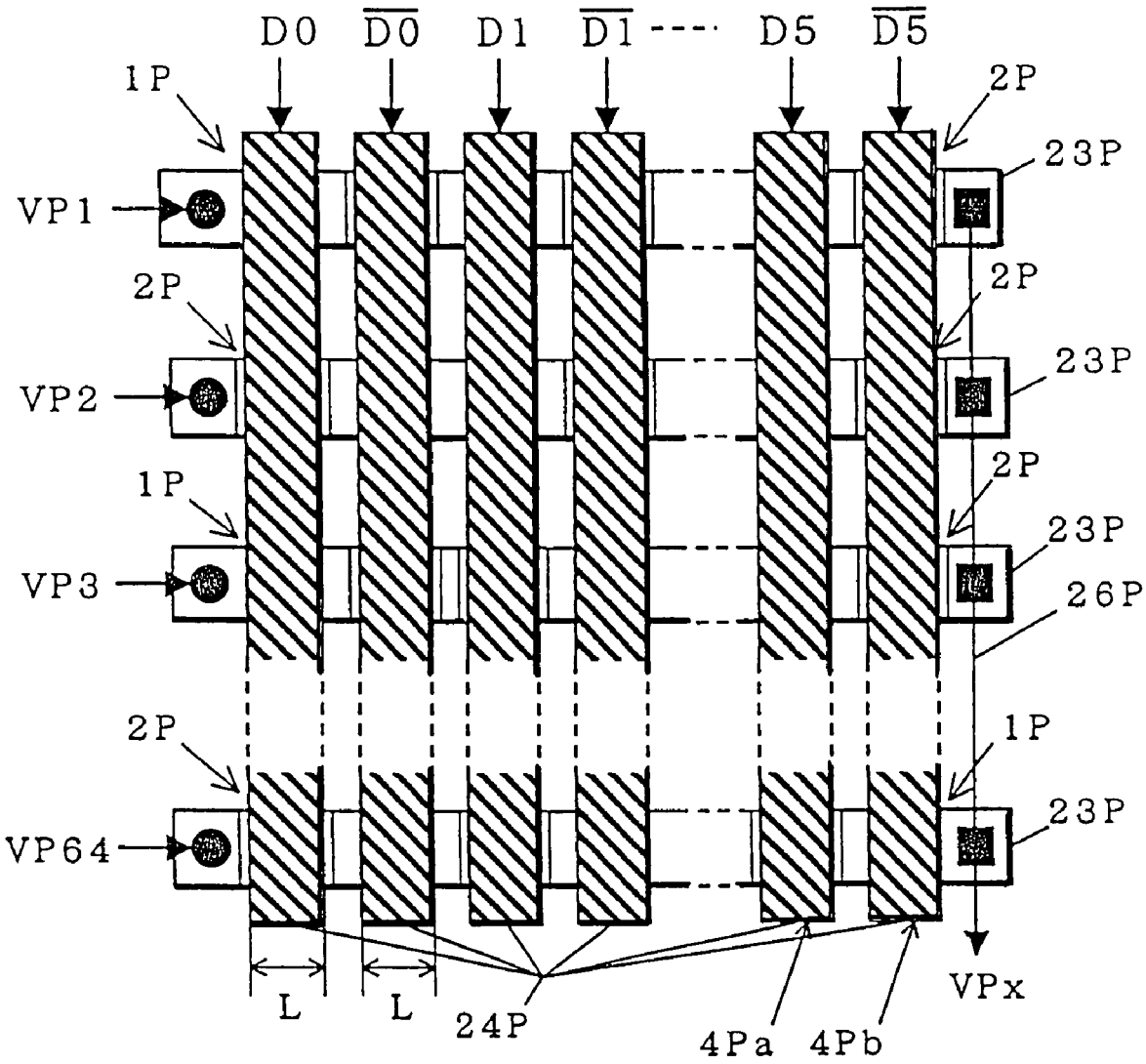
FIG. 8 is a diagram showing a pattern arrangement of gate wires of one stage of the P-ROM decoder of FIG. 7.

As shown in FIG. 8, gate wires 24P having a uniform wire width of L (for example, L=2 μm) and an interval S between gate wires (for example, S=1 μm) are formed as twelve gate wires 14P constituting the six pairs of gate array pairs 4P comprising the gate arrays 4Pa and 4Pb in the P-ROM decoder 216P of one bit. The same pattern arrangement as described above is applied to the gate wires 14N of the N-ROM decoder 216N. Accordingly, the six pairs of enhancement type transistors 1N, 1P and depletion type transistors 2N, 2P (kept under ON-state at all times) of each row of the ROM decoders 216N, 216P are designed to have the same dimension in gate length (=gate wire width L).

Paying attention to the gate wires 14N, 14P of the ROM decoders 216N, 216P, the gate array pairs 4N, 4P are necessarily constructed by a pair of the enhancement type transistor 1N and the depletion type transistor 2N (kept under ON-state at all times) on each row, and a pair of the enhancement type transistor 1P and the depletion type transistor 2P (kept under ON-state at all times) on each row. The transistors 1N, 1P need a predetermined gate length (gate wire width) L, respectively. On the other hand, since the transistors 2N, 2P are designed to be kept under ON-state at all times, these are not required to have the gate length for making a function as a transistor and these may have only a function as conductive wire.

Figure 9:
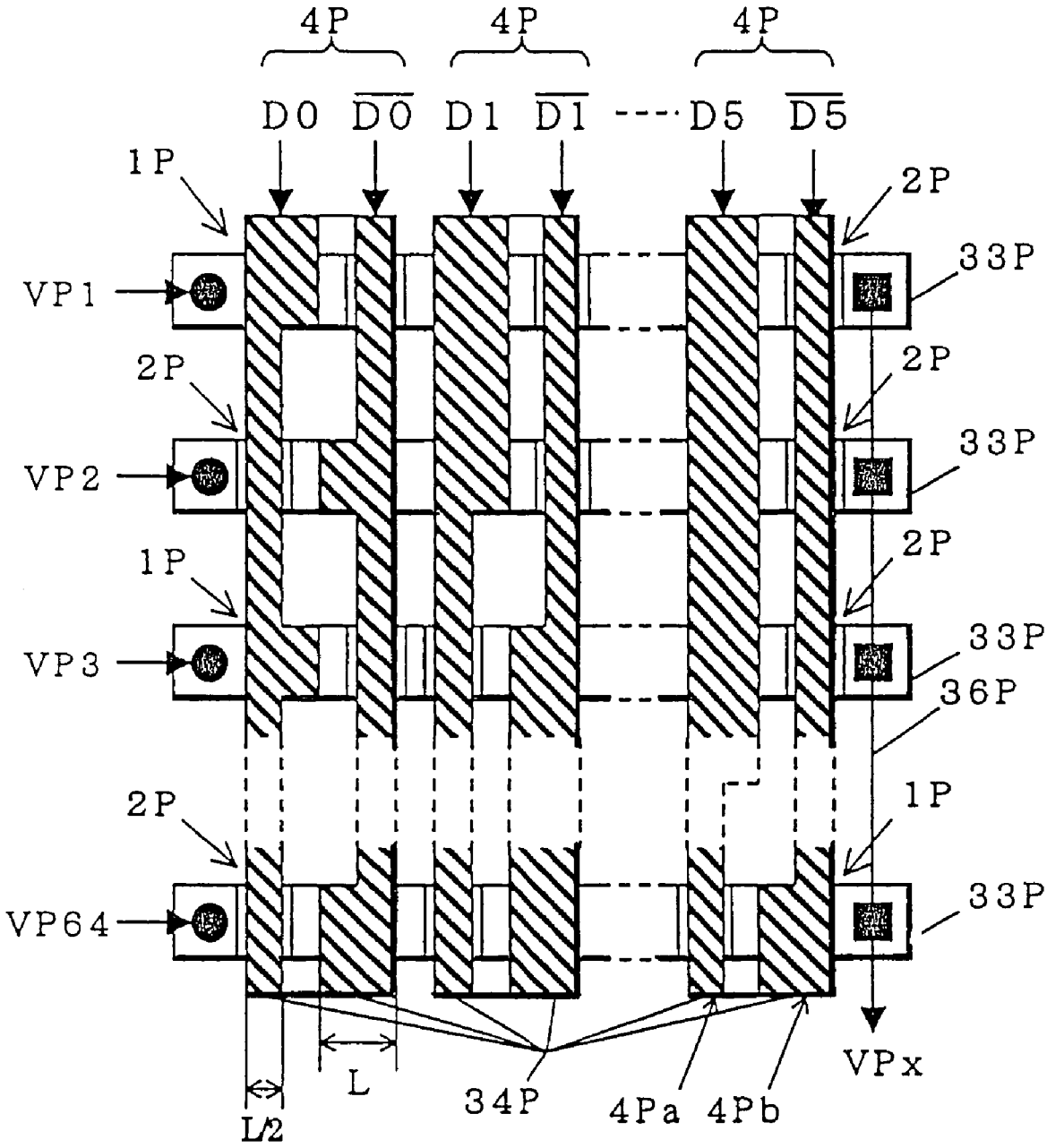
FIG. 9 is a diagram showing a pattern arrangement of gate wires of one stage of the P-ROM decoder of FIG. 7 according to an embodiment of the present invention.

In the data-side driver of this embodiment, the pattern arrangement of the gate wires 14N, 14P of the ROM decoders 216N, 216P on the semiconductor chip 201 is different from the pattern arrangement shown in FIG. 8. The pattern arrangement of the gate wires 14N, 14P of the ROM decoders 216N, 216P on the semiconductor chip 201 will be described by using the gate wires 14P of the P-ROM decoder 216P as an example with reference to FIG. 9.

Gate wires 34P are arranged in a pattern form as twelve gate wires 14P constituting six pairs of gate array pairs 4P comprising gate arrays 4Pa and 4Pb in the P-ROM decode 216P of one bit. In the gate wires 34P, the width of the gate wire that contains the upper portion of the depletion type transistor 2P (kept under ON-state at all times) and extends from the depletion type transistor 2P to the enhancement type transistors 1P adjacent to the depletion type transistor 2P is set to a half of the gate wire width L (for example, a half of L=2 μm) on the transistor 1P so that recess portions are formed at the insides of the confronting gate wires 34P of the respective gate array pairs 4P. This pattern arrangement is formed also for the gate wires 14N of the N-ROM decoder 216N.

Figure 10:
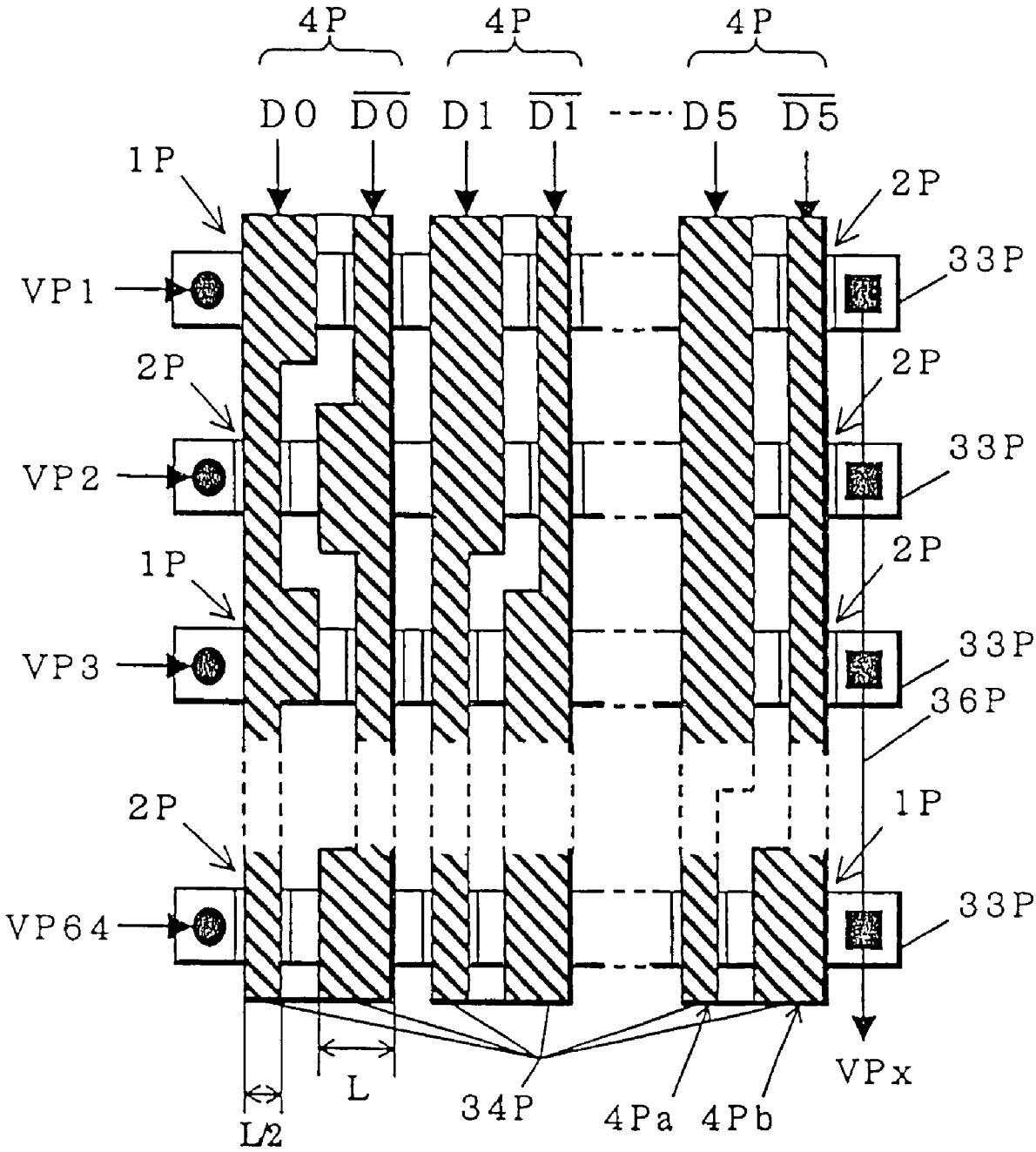
FIG. 10 is a diagram showing a pattern arrangement of gate wires of one stage of the P-ROM decoder of FIG. 7 according to another embodiment of the present invention.

The another pattern arrangement of the gate wires 14N, 14P of the ROM decoders 216N, 216P on the semiconductor chip 201 will be described by using the gate wires 14P of the P-ROM decoder 216P as an example with reference to FIG. 10.

Gate wires 34P are arranged in a pattern form as twelve gate wires 14P constituting six pairs of gate array pairs 4P comprising gate arrays 4Pa and 4Pb in the P-ROM decode 216P of one bit. In the gate wires 34P, the width of the gate wire that contains the upper portion of the depletion type transistor 2P (kept under ON-state at all times) and extends from the depletion type transistor 2P to the position between the depletion type transistor 2P and the enhancement type transistors 1P adjacent to the depletion type transistor 2P is set to a half of the gate wire width L (for example, a half of L=2 μm) on the transistor 1P so that recess portions are formed at the insides of the confronting gate wires 34P of the respective gate array pairs 4P. This pattern arrangement is formed also for the gate wires 14N of the N-ROM decoder 216N.

With respect to each of the pair of the confronting gate wires 34P, the width of the gate wire between continuously-arranged depletion type transistors 2P is reduced so that recess portions are formed inside the confronting gate wires.

The gate wire 24P of the comparative example needs the layout dimension T in the chip longitudinal direction of a pair of gate array pair 4P (T=(gate wire width L+interval S between gate wires)×2=(2 μm+1 μm)×2=6 μm). On the other hand, in the gate wire 34P of this embodiment, the layout dimension T in the chip longitudinal direction of a pair of gate array pair 4P is equal to ((gate wire width L/2)+(common use of gate wire width L/2 and interval S between gate wires)×2+interval S between gate wires)=(1 μm+1 μm)×2+1 μm=5 μm, and thus the layout dimension T in the chip longitudinal direction of a pair of gate array pair 4P can be reduced by 20%. The area of the gate wires can be reduced, and thus the gate capacity can be also reduced.

In the above-described embodiment, when the enhancement type transistors 1P are continuously arranged in the gate array, the gate wire width between the transistors 1P is kept to L, however, it may be set to L/2.

Furthermore, in this embodiment, the dimension of the narrow portions of the gate wires are set to L/2. However, in this embodiment, the dimension concerned is not limited to this value, and it may be set to any value which is smaller than L and within a range in which it functions as a conductive wire.

Figure 7:
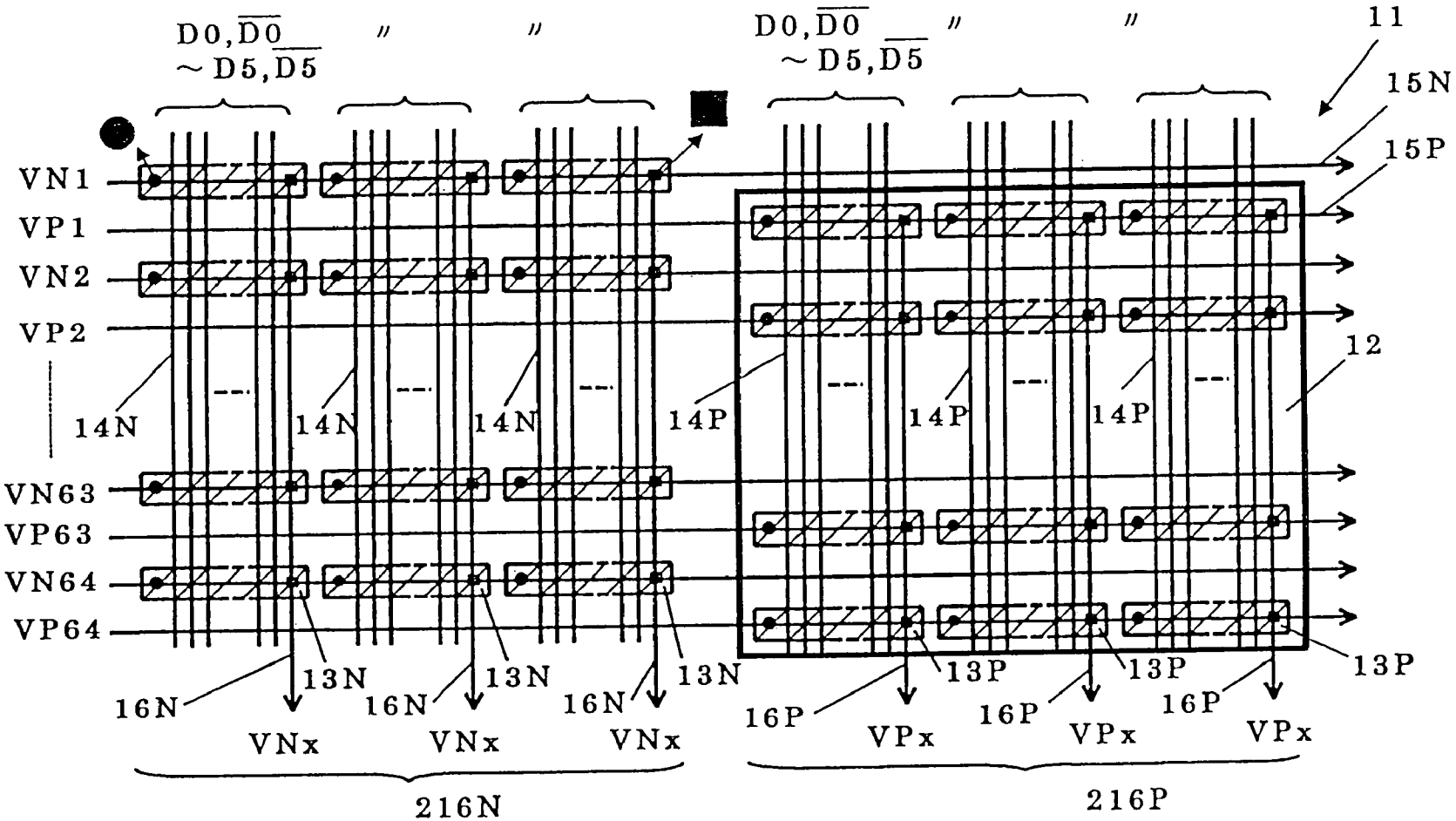
FIG. 7 is a schematic diagram showing a plan pattern on the semiconductor chip of the P-ROM decoder and the N-ROM decoder contained in the circuit block of FIG. 4.

The ROM decoder of this embodiment is not limited to the ROM decoder shown in FIGS. 5 to 7, and if a part for an input of (one bit×one gradation) in a ROM decoder is constructed by a pair of an enhancement type transistor and a depletion type transistor (kept under ON-state at all times), the ROM decoder may be applied to this embodiment.

Figure 2:
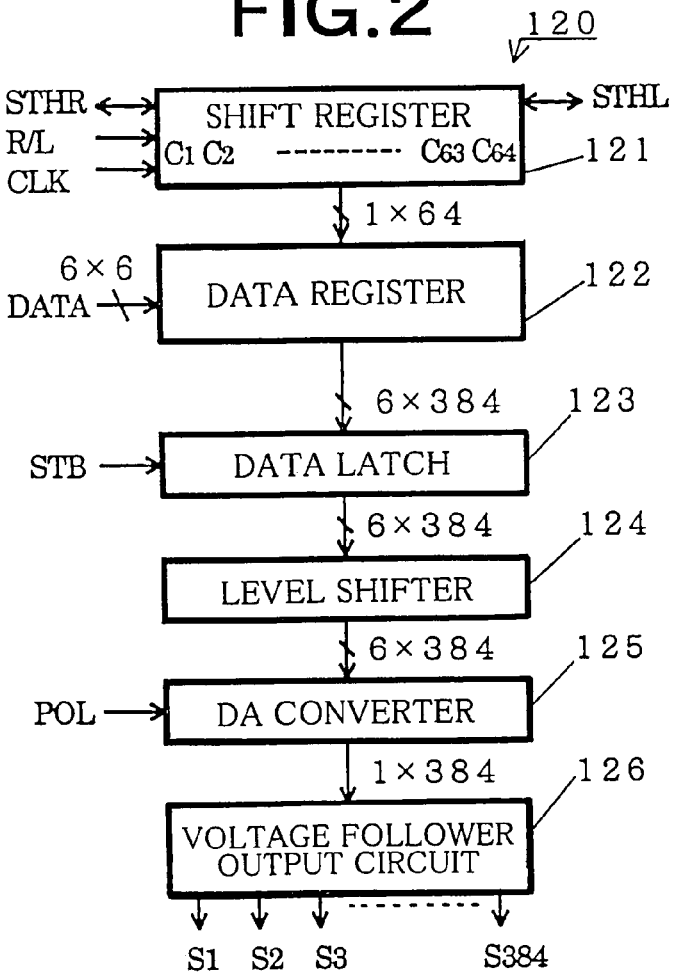
PRIOR ART FIG. 2
FIG. 2 is a block diagram showing the schematic construction of a data-side driver used in the liquid crystal display device of FIG. 1.

The data-side driver of this embodiment is not limited to the data-side driver shown in FIGS. 2 to 4, and if it is equipped with a ROM decoder for converting a digital signal representing an input gradation level to a gradation voltage of an analog signal and a part for an input of (one bit×one gradation) in the ROM decoder is constructed by a pair of an enhancement type transistor and a depletion type transistor (kept under ON-state at all times), the data-side driver may be applied to this embodiment. If this condition is satisfied, it may be applied to a line reverse driving method.

Figure 1:
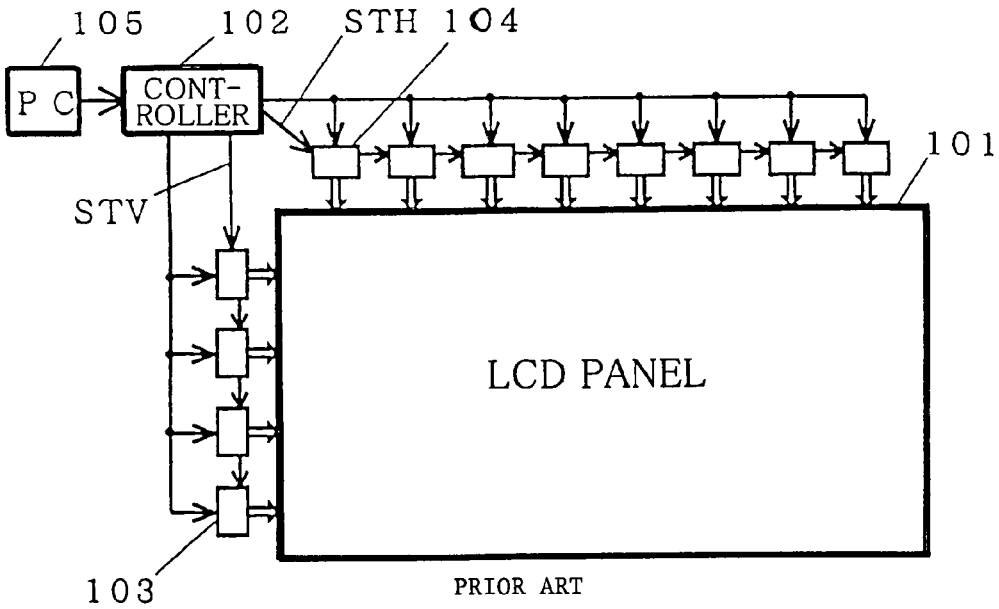
FIG. 1 is a schematic diagram showing the construction of a liquid crystal display device.

The semiconductor integrated circuit device of this embodiment can be used for a display device such as a liquid crystal display device of FIG. 1 but may be used in many ways.

According to this embodiment, the layout dimension of the arrangement of both the gate wires in the chip longitudinal direction can be reduced and also the gate wire area can be reduced by the narrowed amount of the gate wire width. Therefore, there can be provided a liquid crystal driving semiconductor integrated circuit device in which the layout area of the ROM decoder and the gate capacity can be reduced.

What is claimed is:

1. A semiconductor integrated device comprising a ROM decoder of n bits for selecting one gradation voltage out of gradation voltages of the n-th power of 2 gradation in connection with data signals of n bits (n represents an integer of 2 or more) representing a gradation level, said ROM decoder having n pairs of confronting gate wires each into which the data signal is input with the non-inverted state on one of the pair and with the inverted state on another of the pair, wherein pairs of the n-th power of 2 each of which comprises an enhancement type transistor and a depletion type transistor kept under ON-state are arranged at predetermined positions one side by one side at the pair of the confronting gate wires, and with respect to each of the pair of the confronting gate wires, the width of the gate wire that contains the upper portion of the depletion type transistor and extends from the depletion type transistor to the enhancement type transistor adjacent to the depletion type transistor is reduced with respect to the width of the gate wire than contains the upper portion of the adjacent enhancement type transistor so that recess portions are formed inside the confronting gate wires with the width of the gate wire that contains the upper portion of the depletion type transistor being narrower than the width of the gate wire than contains the upper portion of the adjacent enhancement type transistor.

2. The semiconductor integrated circuit device according to claim 1, wherein the width of the gate wire that contains the upper portion of the depletion type transistor and extends from the depletion type transistor to the position between the depletion type transistor and the enhancement type transistor adjacent to the depletion type transistor is reduced so that recess portions are formed inside the confronting gate wires.

3. The semiconductor integrated circuit device according to claim 1, wherein with respect to each of the pair of the confronting gate wires, the width of the gate wire between continuously-arranged depletion type transistors is reduced so that recess portions are formed inside the confronting gate wires.

4. The semiconductor integrated circuit device according to claim 2, wherein with respect to each of the pair of the confronting gate wires, the width of the gate wire between continuously-arranged depletion type transistors is reduced so that recess portions are formed inside the confronting gate wires.

5. The semiconductor integrated circuit device according to claim 1, wherein the reduced width of the gate wire is equal to a half of the gate wire width on the enhancement type transistor.

6. The semiconductor integrated circuit device according to claim 2, wherein the reduced width of the gate wire is equal to a half of the gate wire width on the enhancement type transistor.

7. A liquid display device comprising the semiconductor integrated circuit device according to claim 1.

8. A liquid display device comprising the semiconductor integrated circuit device according to claim 2.

9. A semiconductor integrated device, comprising:

an n-bits RON decoder for selecting one gradation voltage out of plural gradation voltages in connection with data signals of n bits representing a gradation level, said ROM decoder having pairs of confronting gate wires connected to input into each pair the data signals with a non-inverted state on one of the pair and with an inverted state on another of the pair, each pair of confronting gate wires corresponding to plural enhancement type transistors and depletion type transistors, a first width of the gate wire that contains an upper portion of the depletion type transistor being narrower than a second width of the gate wire than contains an upper portion of an adjacent enhancement type transistor such at a recess is formed within the gate wire between two enhancement type transistors.

10. The semiconductor integrated circuit device according to claim 9, wherein the first width of the gate wire of the depletion type transistor is equal to a half of the second width on the enhancement type transistor.

11. The semiconductor integrated circuit device according to claim 9, wherein an overall width of the pair of confronting gate wires is twice the second width.

12. A semiconductor integrated device, comprising:

a ROM decoder for selecting one gradation voltage out of plural gradation voltages in connection with data signals of n bits representing a gradation level, said ROM decoder having pairs of confronting gate wires connected to input into each pair the data signals with a non-inverted state on one of the pair and with an inverted state on another of the pair, each gate wire having a first width over an upper portion of the depletion type transistor and a second width over an upper portion of an adjacent enhancement type transistor, the first width being less than the second width such at a recess is formed in the gate wire between two enhancement type transistors.

13. The semiconductor integrated circuit device according to claim 12, wherein the first width of the gate wire over the depletion type transistor is equal to a half of the second width of the gate wire over the enhancement type transistor.

14. The semiconductor integrated circuit device according to claim 12, wherein an overall width of the pair of confronting gate wires is twice the second width.

15. The semiconductor integrated circuit device according to claim 13, wherein an overall width of the pair of confronting gate wires is twice the second width.

* * * * *